US006526791B2

(12) United States Patent
Shvarts

(10) Patent No.: US 6,526,791 B2
(45) Date of Patent: Mar. 4, 2003

(54) HIGH SECURITY CYLINDER LOCK AND KEY

(75) Inventor: Vladimir Shvarts, Woodmere, NY (US)

(73) Assignee: Arrow Lock Manufacturing Company, Brooklyn, NY (US)

( * ) Notice: Subject to any disclaimer, the term of this patent is extended or adjusted under 35 U.S.C. 154(b) by 14 days.

(21) Appl. No.: 09/792,985

(22) Filed: Feb. 26, 2001

(65) Prior Publication Data

US 2002/0116968 A1 Aug. 29, 2002

(51) Int. Cl.[7] ..... E05B 15/14

(52) U.S. Cl. ..... 70/419; 70/409; 70/421; 70/493; 70/495

(58) Field of Search ..... 70/358, 409, 419, 70/421, 493, 495

(56) References Cited

U.S. PATENT DOCUMENTS

| | | | | | |
|---|---|---|---|---|---|
| 4,723,427 | A | * | 2/1988 | Oliver | 70/366 |
| 4,854,146 | A | * | 8/1989 | O'Connell et al. | 70/277 |
| 5,479,800 | A | * | 1/1996 | Myers | 70/365 |
| 5,819,566 | A | * | 10/1998 | Eden, Jr. | 70/358 |
| 5,823,030 | A | * | 10/1998 | Theriault et al. | 70/389 |
| 5,964,111 | A | * | 10/1999 | Lambert | 70/380 |

FOREIGN PATENT DOCUMENTS

| | | | | |
|---|---|---|---|---|
| DE | 3817494 A1 | * | 11/1989 | E05B/27/10 |
| EP | 161654 A2 | * | 11/1985 | 70/493 |
| GB | 2230555 A | * | 10/1990 | E05B/27/00 |

* cited by examiner

*Primary Examiner*—Anthony Knight
*Assistant Examiner*—Christopher Boswell
(74) *Attorney, Agent, or Firm*—DeLio & Peterson, LLC

(57) ABSTRACT

A cylinder lock includes a shell and a plug inside the shell. A locking pin, a sensor pin and a flexible coupling are mounted within the plug. The sensor pin moves the flexible coupling and the coupling moves the locking pin to an unlocked position when the correct key is inserted into a key slot in the plug. The key includes a locking pin receiving notch, to allow the locking pin to move to the unlocked position. The key also includes a contact surface that moves the sensor pin and thereby moves the locking pin to the unlocked position through the flexible coupling. When an incorrect key, without the locking pin receiving notch, is inserted, the flexibility of the flexible coupling allows the sensor pin to move without moving the locking pin. The cylinder lock may also include conventional pin tumblers. The receiving notch of the key may be provided with an alignment surface that cooperates with the locking pin to control the depth the key is inserted into the lock and allow keys of varying length to align relative to the pin tumblers of the cylinder lock.

35 Claims, 4 Drawing Sheets

HIGH SECURITY CYLINDER LOCK AND KEY

BACKGROUND OF THE INVENTION

1. Field of the Invention

The present invention relates to high security cylinder locks and keys for such locks. More particularly, the present invention relates to cylinder locks that use an additional independent locking mechanism to supplement a conventional pin tumbler locking mechanism.

2. Description of Related Art

Cylinder locks include a cylindrical plug that turns inside a shell. The plug is provided with a key slot and is connected at one end to a mechanism to be operated by the cylinder lock. Inserting the correct key and rotating the plug relative to the shell operates the lock mechanism. Preventing the plug from rotating relative to the shell keeps the mechanism locked.

In a conventional cylinder lock the plug is locked relative to the shell with a pin tumbler mechanism including multiple pins located in a series of evenly spaced pin chambers that extend across the shear surface at the interface between the plug and the shell. Each pin chamber includes at least a lower pin, an upper pin and a spring. Additional pins may also be included in each chamber. The lengths of the pins vary and the upper surface of the correct key is machined to correspond to the lengths of the pins so that the interface between the upper pin and the lower pin in each pin chamber is aligned with the shear surface between the plug and the shell.

With the correct key inserted, the lower pin in each pin chamber is inside the plug and the upper pin in each pin chamber is in the shell. The key can then turn the plug. If the incorrect key is inserted, one or more pins will extend across the shear surface and prevent the plug from being turned.

One application for cylinder locks is in removable core lock mechanisms. In removable core designs the shell must fit into, and be removable from, a standard casing that has an opening that exactly matches the exterior shape of the shell. In one common design, the exterior shape of the shell has a cross section that approximates the shape of the numeral "8." The upper half of the shell provides the required space for the primary pin tumbler mechanism. The lower half is relatively thin-walled and includes an opening to receive the cylindrical plug and locking tab (also called a control sleeve).

To improve security, it is known to add an additional locking mechanism to the cylinder lock that operates independently from, or in conjunction with, the conventional pin tumbler locking mechanism. The additional mechanism includes one or more locking elements that extend across the shear surface between the plug and the shell to prevent the plug from being turned. When the correct key is inserted, the locking elements are allowed to move so that they no longer extend across the shear surface and thereby allow the plug to rotate relative to the shell.

One known type of additional locking mechanism includes a second conventional pin tumbler mechanism. The pins in the second pin tumbler mechanism may contact the side of the key, the bottom of the key or they may be parallel to and adjacent to the first set of pins. Although this solution is effective, it requires additional space in the shell for the additional pin chambers, springs and pins that fit within the chambers. The required additional space in the shell is not always available for conventional cylinder lock designs.

To add a secondary conventional pin tumbler mechanism to a primary pin tumbler locking mechanism is not an option for a removable core design. Therefore, it is highly desirable for any additional locking mechanism between the plug and the shell to be primarily located within the plug, not within the shell.

Nonetheless, it is difficult to fit a supplemental locking mechanism entirely within the plug. The plug must have a key slot that approximately bisects the plug, as well as the pin chambers of the primary locking mechanism. This leaves only limited space within the plug. The space available in the plug is particularly limited in the radial direction, which is the direction needed to accommodate a conventional pin-tumbler design in which a coil spring is axially aligned with a locking pin.

Other known types of supplemental or secondary locking mechanisms are expensive to manufacture or cannot be integrated into existing installed systems in the field.

Yet another problem with conventional cylinder locks relates to the manner in which the key is aligned relative to the locking mechanisms in the lock. In order for the lock to be operated, the key must be inserted and must stop at the correct inserted distance relative to the locking mechanisms inside the cylinder lock.

Conventional cylinder locks do this by providing an alignment stop surface on the end of the key or at the base of the key between the key bow and the key blade. The alignment stop surface at the base or tip of the key contacts a corresponding alignment stop surface at the front or rear of the plug when the key is inserted.

Although putting the stop at the base or tip of the key is standard, it would improve security to put the stop at a non-standard location. This would make copying a key more difficult. A non-standard location for the stop also would make it possible to use keys of different lengths to operate the same lock. It would not be required that the key blade be long enough to reach a stop at the rear of the lock or that the distance from the key bow to the locking elements in the key be fixed.

It is common for a family of similar lock mechanisms to be constructed using five, six or seven conventional pin tumblers. Placing the alignment stop at a non-standard location on the key provides many options for keying, improving security, and varying lock design, particularly when multiple locks of different lengths are used.

Bearing in mind the problems and deficiencies of the prior art, it is therefore an object of the present invention to provide a cylinder lock with an additional locking mechanism that fits substantially completely within the plug and supplements a conventional pin tumbler locking mechanism.

A further object of the invention is to provide a cylinder lock that can be used in a removable core design where the locking mechanism does not extend into the upper half of the shell or interfere with the locking tab or other mechanism that locks a removable core cylinder lock into a surrounding shell.

It is still another object of the invention to provide a cylinder lock and key that can be integrated into and be a part of an existing installed door lock system using the original cross sectional shape for the keys and mating keyways.

It is yet another object of the present invention to provide a cylinder lock and key that cooperate to stop the insertion of the key at a desired aligned location relative to the lock without regard to the length of the key.

Still other objects and advantages of the invention will in part be obvious and will in part be apparent from the specification.

SUMMARY OF THE INVENTION

The above and other objects, which will be apparent to those skilled in art, are achieved in the present invention which is directed to a cylinder lock that includes a shell, a plug having a key slot formed therein, a locking pin movable between a locked position and an unlocked position, a sensor pin movable between an extended position and a retracted position and a flexible coupling connected between the locking pin and the sensor pin.

The plug is rotatably mounted within the shell to define a shear surface between the plug and the shell. The locking pin extends across the shear surface in the locked position to lock the plug against rotation relative to the shell and the sensor pin extends at least partially into the key slot in the extended position. The flexible coupling moves the locking pin to the unlocked position when the sensor pin moves to the retracted position. The coupling is sufficiently flexible that the locking pin can remain in the locked position when the sensor pin moves to the retracted position whenever the locking pin is blocked from moving to the unlocked position.

In the preferred design, the flexible coupling is located entirely inside the plug and the locking pin extends at least partially into the key slot when the locking pin is in the unlocked position. A bias spring is connected to urge the locking pin toward the locked position. The bias spring does not need to be in axial alignment with the locking pin, and it is preferred that the bias spring operate against a flexible rod, forming the flexible portion of the flexible coupling. The rod flexes whenever the sensor pin moves to the retracted position and the locking pin is blocked from moving to the unlocked position. The locking pin may be connected to the flexible rod with an opening in the side of the locking pin.

In the most highly preferred design of the cylinder lock, the flexible coupling includes a cam, the flexible rod and a pivot for the cam to rotate on. The pivot is positioned between the locking pin and the sensor pin and the cam turns on the pivot to move the locking pin to the unlocked position when the sensor pin moves to the retracted position.

The locking pin and sensor pin need not be perpendicular or parallel to the plane of the key blade. It is preferred that they be at an angle between zero and ninety degrees to the plane of the key blade to give them maximum room for the required sliding motion within the radial confines of the plug.

The present invention is also directed to the key for use with the cylinder lock of the invention and to a cylinder lock mechanism including the key and the cylinder lock. The key includes a key bow for turning the key and a key blade having a cross sectional shape selected to fit within the key slot in the plug of the cylinder lock. The key blade includes a locking pin receiving notch at a first location and a contact surface at a second location on the key blade.

The locking pin receiving notch has a size sufficient to receive a locking pin extending into the key slot from the cylinder lock. The locking pin receiving notch cooperates with the locking pin in the cylinder lock and the contact surface cooperates with the sensor pin in the cylinder lock to lock and unlock the plug of the cylinder lock relative to the shell of the cylinder lock. In the most highly preferred embodiment of the invention, the locking pin receiving notch is cut into the key at an angle relative to the plane of the key blade that matches the angle of the locking pin relative to the plane of the key blade.

In another aspect of the key of this invention, the locking pin receiving notch in the key includes an alignment surface contacting the locking pin when the key blade is inserted into the key slot and cooperating with the locking pin to stop insertion of the key blade into the key slot at a desired position relative to the plug of the cylinder lock. This allows the locking pin receiving notch to stop the insertion of the key at the required location for the key to be able to operate the primary pin tumbler locking mechanism.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–14 of the drawings in which like numerals refer to like features of the invention.

Figure 1:
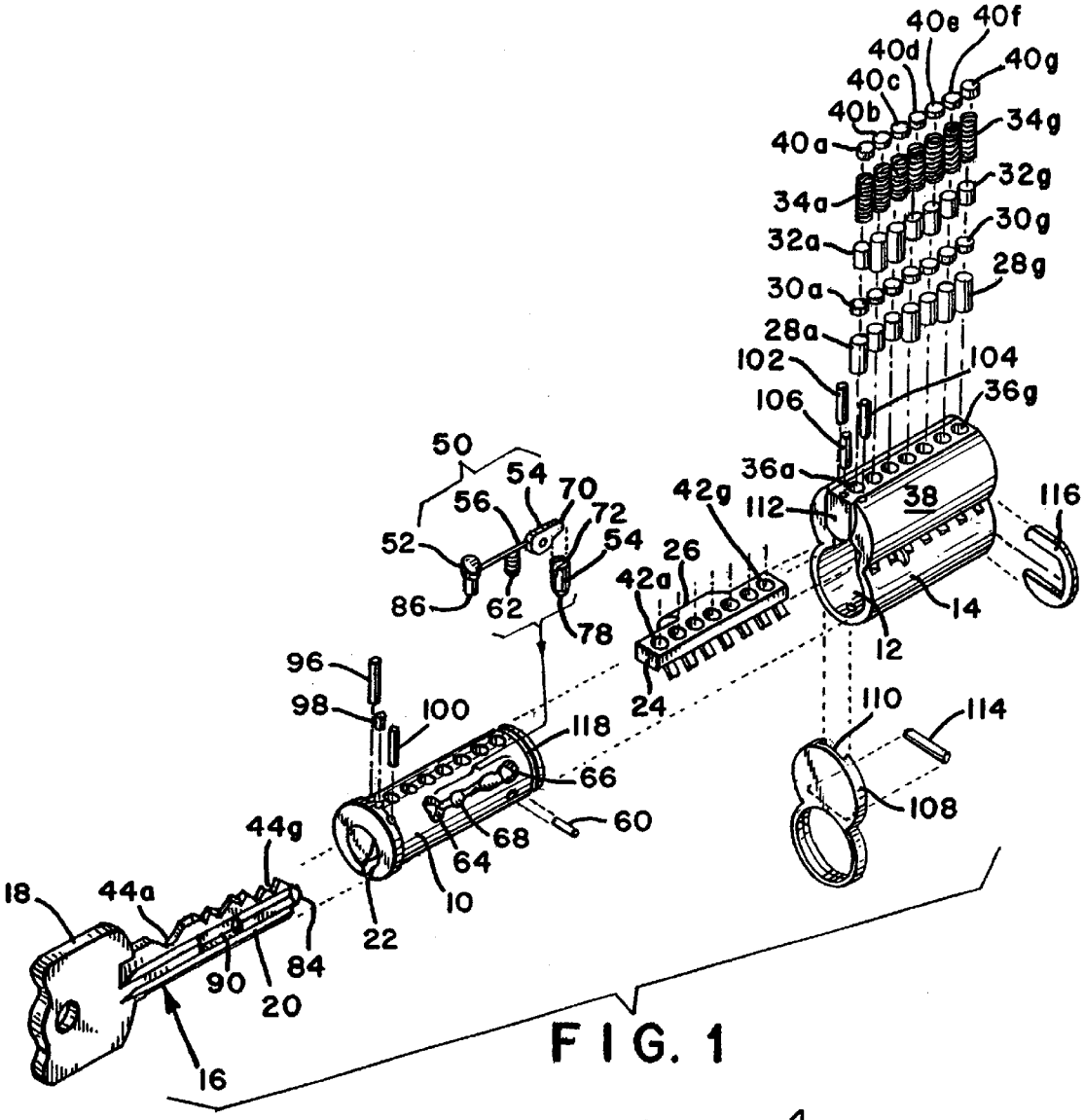
FIG. 1 is an exploded perspective view of the cylinder lock mechanism of the present invention.
Figure 2:
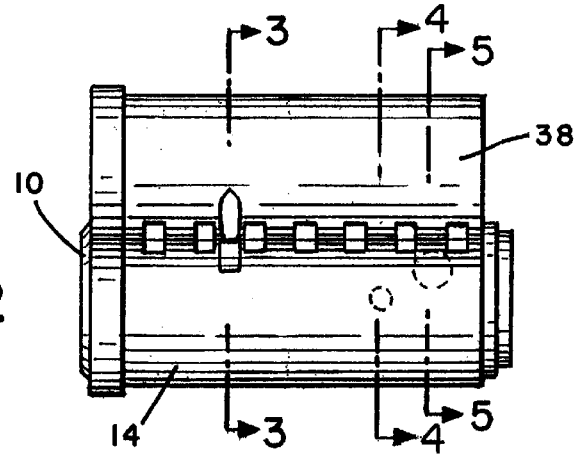
FIG. 2 is a right side elevational view of the assembled plug and shell of the cylinder lock seen in FIG. 1.

Referring to FIG. 1, the present invention includes a cylinder lock mechanism having a cylindrical plug 10 inserted into a substantially cylindrical opening 12 in a shell 14. A key 16 for operating the lock includes a key bow 18 and a key blade 20. The cross section of the key blade (see FIG. 8) matches the cross sectional shape of the key slot 22 in the plug 10.

In the preferred design shown in FIG. 1, the cylinder lock is a removable core cylinder lock, however, the invention may also be used in non-removable core applications. In a removable core design, the entire shell 14 is inserted into a matching opening in an outer casing (not shown). The shell 14 is locked into the casing by a locking tab 24 that can be rotated counterclockwise and locked into place to extend rectangular projection 26 out of the left side of the shell 14. Alternatively, the locking tab 24 can be rotated clockwise with an appropriate key to retract rectangular projection 26 into the shell. This allows the shell to be withdrawn from the outer casing, so that the cylinder lock can be rapidly changed.

The locking tab 24 is locked into the extended position by a conventional pin tumbler primary locking mechanism. The primary locking mechanism is composed of lower pins 28*a*–28*g*, intermediate pins 30*a*–30*g*, upper pins 32*a*–32*g* and springs 34*a*–34*g*. The pins and springs are all inserted into pin chambers 36*a*–36*g* in the upper portion 38 of the shell 14 and are held in their corresponding pin chambers by pin caps 40*a*–40*g*.

The locking tab 24 includes pin chambers 42*a*–42*g* that are aligned with pin chambers 36*a*–36*g* when the locking tab 24 is at the counterclockwise position with the rectangular tab 26 extending out of the side of the shell 14. This position for the locking tab locks the shell into its outer casing. In this locked position the pin chambers 42*a*–42*g* function as the lower half of pin chambers 36*a*–36*g*.

The key 16 is provided with a series of corresponding cuts 44*a*–44*g*. These cuts can be varied in depth to cooperate with the multiple pins in the primary locking mechanism in different ways. When the key cuts 44*a*–44*g* align the interfaces between the pins with the shear surface 80 between plug and the shell, the key will turn the plug 10 relative to the shell 14, but will not permit the locking tab 24 to be rotated. Alternatively, the key cuts may be set to produce a key that will allow the locking tab 24 to be rotated relative to the shell 14 to remove the shell from the casing.

The operation of the primary locking mechanism and the locking tab 24 is known and is disclosed in detail in U.S. Pat. No. 6,079,240 issued on Jun. 27, 2000, the disclosure of which is incorporated herein by reference. The present invention, however, includes an additional locking mechanism, marked with reference number 50, which fits substantially completely within the plug 10. Because it is inside the plug, it does not interfere with the locking tab 24 above it, nor is any additional space required within the shell 14. The additional locking mechanism includes a locking pin 52, a sensor pin 54 and a flexible coupling that extends between the locking pin and the sensor pin. The flexible coupling is composed of a flexible rod 56, a cam 58 that turns on pivot 60 and a biasing spring 62.

The locking pin 52 slides inside bored opening 64. The sensor pin 54 fits within bored opening 66 and the flexible coupling fits within slot 68. The two bored openings 64 and 66 extend into the key slot 22 so that the pins can contact the key blade 20 when it is inserted. The pivot pin 60 extends perpendicularly through the slot 68 and acts as a rocker pivot that the cam 58 rotates on. Cam 58 includes a tip 70 that engages slot 72 in the top of sensor pin 54.

The sensor pin 54 can move in toward the key slot (the extended position) so that its inner end 8 extends into the key slot to sense whether a key is in the key slot. Alternatively, the sensor pin can be pushed outward away from the key slot (the retracted position) when the key blade is inserted. In both positions, the sensor pin remains entirely within the plug 10, and the plug remains free to rotate. The function of the sensor pin is to determine whether a key blade is in the key slot, move between the extended and retracted positions accordingly, and activate the locking mechanism.

The locking pin 52 moves in a similar manner. The locking pin can move in toward the key slot to an unlocked position or out to a locked position. Like the sensor pin, the inner end 86 of the locking pin extends into the key slot when the locking pin is fully inserted in its bored opening 64 (the unlocked position). In the unlocked position, the locking pin is completely inside the plug and the plug is free to turn relative to the shell. However, the locking pin is longer than the sensor pin and extends across the shear surface between the plug and the shell when the locking pin moves outward to the locked position.

The flexible coupling links the sensor pin 54 and the locking pin 52 such that when the sensor pin 54 moves out (to the retracted position, relative to the key slot), the locking pin 52 moves in (to the unlocked position). Conversely, when the sensor pin 54 moves in, the locking pin 52 moves out (to the locked position).

Figure 3:
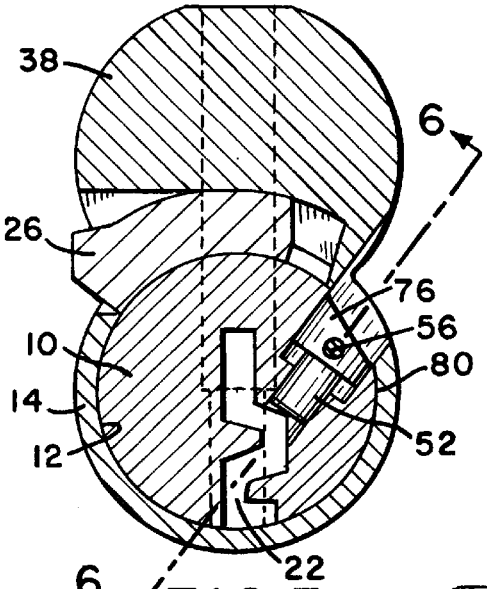
FIG. 3 is a cross sectional view of the cylinder lock taken along the line 3—3 in FIG. 2.
Figure 4:
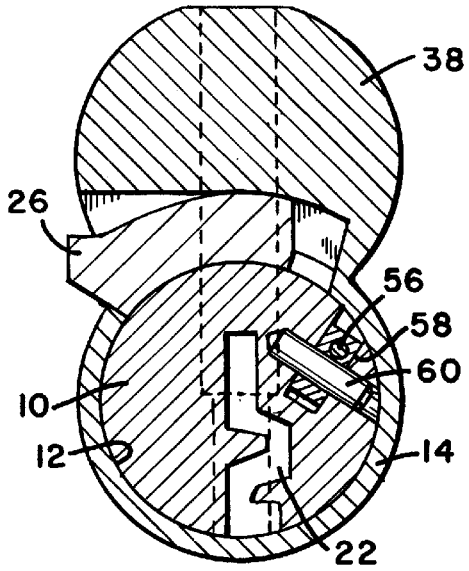
FIG. 4 is a cross sectional view of the cylinder lock taken along the line 4—4 in FIG. 2.
Figure 5:
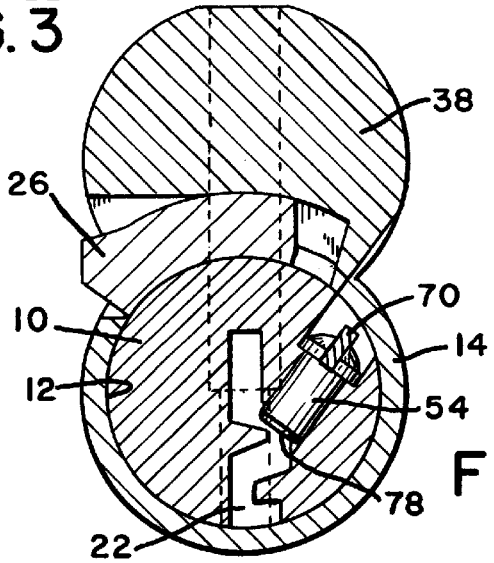
FIG. 5 is a cross sectional view of the cylinder lock taken along the line 5—5 in FIG. 2.
Figure 6:
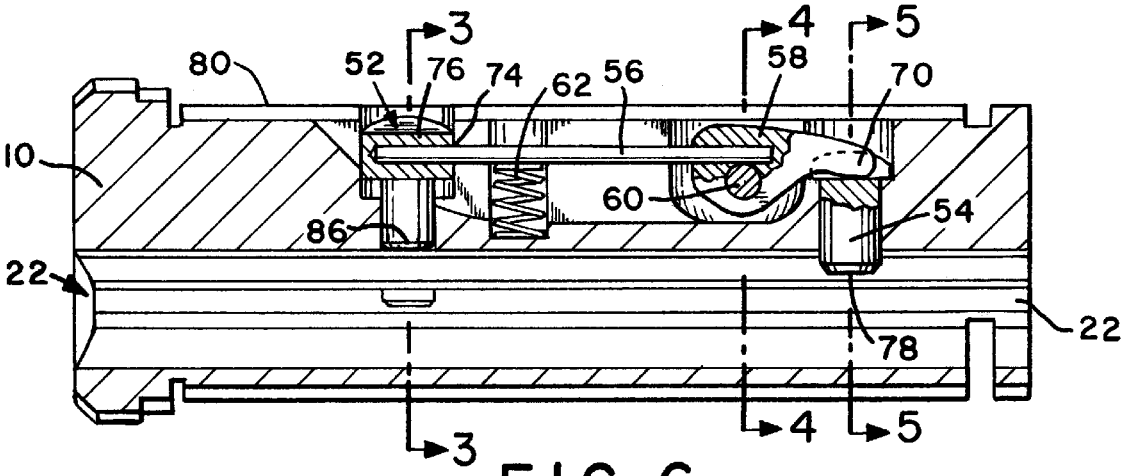
FIG. 6 is a cross sectional view of the plug, removed from the shell, taken along the line 6—6 in FIG. 3. The lock is shown in the locked position with no key inserted.

FIGS. 3, 4 and 5 provide cross sections through the locking pin 52, the pivot pin 60 and the sensor pin 54, respectively. These cross sections are taken perpendicular to the axis of the plug 10. FIG. 6 provides a cross section taken parallel to the axis of the plug 10 along slot 68 and shows the interaction of the locking pin and the sensor pin. FIGS. 3, 4, 5 and 6 all show the key removed from the key slot 22.

As can be seen in FIGS. 5 and 6, end 78 of the sensor pin 54 extends into the key slot 22 when there is no key blade in the key slot 22. The flexible rod 56 is pushed away from the key slot by bias spring 62. The biasing force on the rod 56 pivots cam 58 around pivot pin 60, thereby pushing against the head of sensor pin 54 and sliding the sensor pin towards the key slot where it's beveled end 78 is in position to sense the insertion of a key.

As can be seen in FIG. 6, the flexible rod 56 engages an opening 74 in the side of the locking pin 52. Accordingly, the upward force from spring 62 also biases the locking pin 52 towards the locked position. The head 76 of the locking pin 52 extends across the shear surface 80 defined between the outer surface of the plug 10 and the inner surface of the cylindrical opening 12 in the shell 14. The head 76 of the locking pin 52 extends into a matching opening 82 (see FIG. 10) in the thin wall section of the lower half of the shell 14.

As can be seen in FIGS. 3, 4 and 5, the locking mechanism 50 fits substantially completely within the plug 10. Only the head 76 of the locking pin 52 extends outward from the cylindrical outer surface of the plug, and it does so only when the locking pin is in the locked position, as needed to prevent rotation of the plug 10 relative to the shell 14. The bias spring 62 keeps the locking pin 52 extended outward in the locked position and the sensor pin 54 in the extended position where its lower end 78 enters the key slot 22.

The axes of the locking pin and the sensor pin need not be perpendicular to the plane of the key blade. As can be seen in the cross sectional views, it is preferred that these pins be at a non-perpendicular angle ranging from zero to ninety degrees to the plane of the key blade. The preferred angle and position is the angle that gives them maximum room for their required sliding motion within the radial confines of the plug 10.

It should be understood that the locking mechanism may be installed in any part of the cylindrical plug and that the angle of the pin axis referred to above is to be measured from the projection of the pin axis on the plane of the key blade upwards to the axis of the pin above it. Accordingly, this angle will always be less than ninety degrees, unless the pin is perpendicular to the plane of the key blade.

Figure 7:
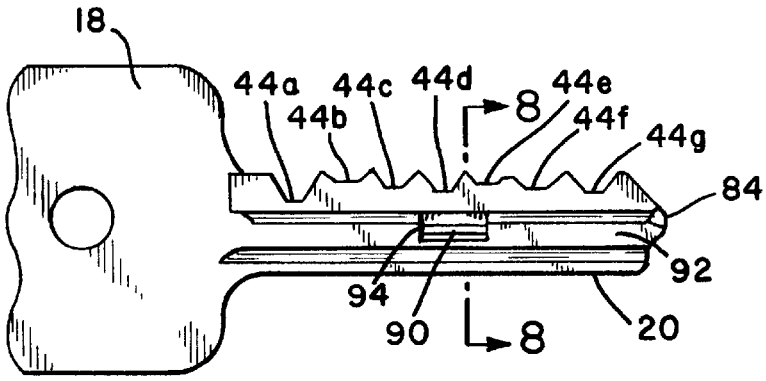
FIG. 7 is a side elevational view of the key of the present invention.
Figure 8:
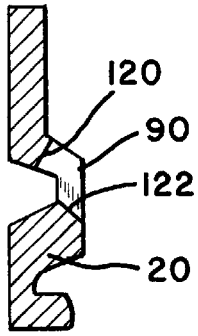
FIG. 8 is a cross sectional view of the key taken along the line 8—8 in FIG. 7.
Figure 9:
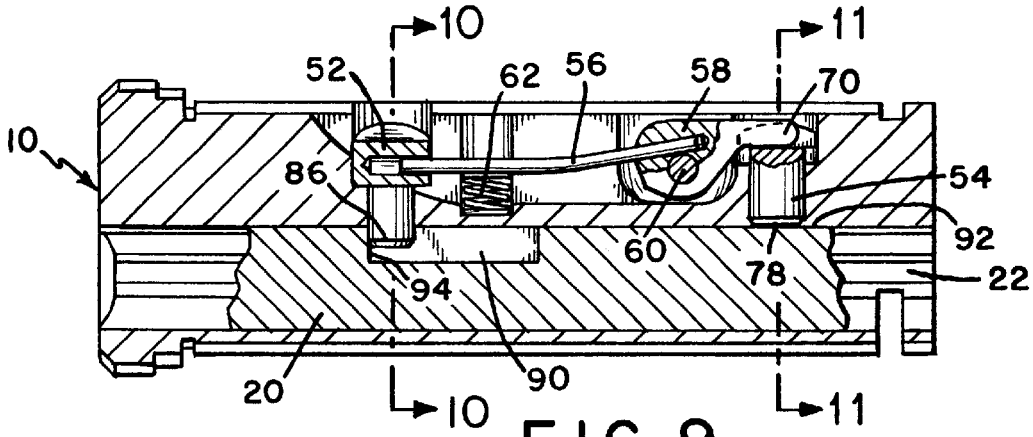
FIG. 9 is a cross sectional view of the plug, removed from the shell, corresponding to the cross sectional view of FIG. 6 except that the lock is shown in the unlocked position with the correct key inserted.
Figure 10:
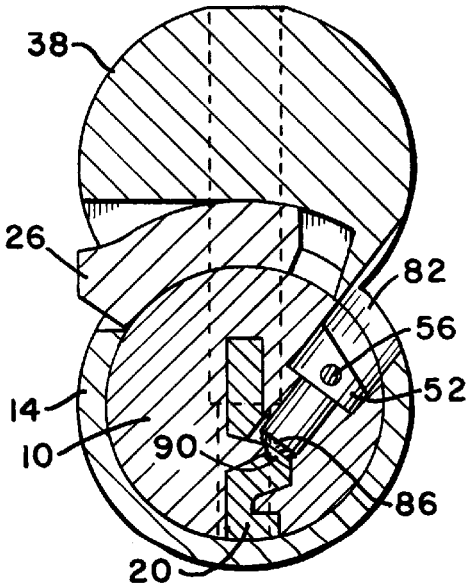
FIG. 10 is a cross sectional view of the cylinder lock taken along the line 10—10 in FIG. 9.
Figure 11:
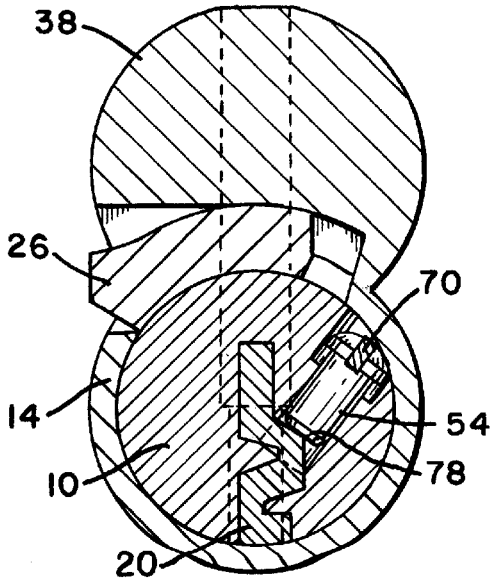
FIG. 11 is a cross sectional view of the cylinder lock taken along the line 11—11 in FIG. 9.

FIGS. 9, 10 and 11 provide cross sections that correspond to FIGS. 6, 3 and 5 respectively, except that the locking mechanism is shown with the correct key inserted. As can be seen in FIGS. 1, 7 and 8, the key includes a locking pin receiving notch 90 that permits the locking pin 52 to move into the key slot 22 while the key is also in the key slot. The key also includes a contact surface 92 that lies directly under the sensor pin 54 when the key is inserted. The contact surface 92 holds the sensor pin 54 out of the key slot 22.

As the key 16 is inserted, a bevel 84 on the key contacts the beveled end 78 on the sensor pin 54 and pushes the sensor pin to the retracted position. The motion of the sensor pin rotates cam 58 about pivot pin 60, compressing bias spring 62 with flexible rod 56 and pushing the locking pin 52 to the unlocked position.

As can be seen in FIGS. 9 and 10, the unlocked position for locking pin 52 requires that the inner end 86 of the locking pin 52 extend into the key slot 22. Accordingly, the key in the key slot must contain a locking pin receiving notch 90 of a size and shape sufficient to permit the locking pin to move to the unlocked position and into the key slot.

Figure 12:
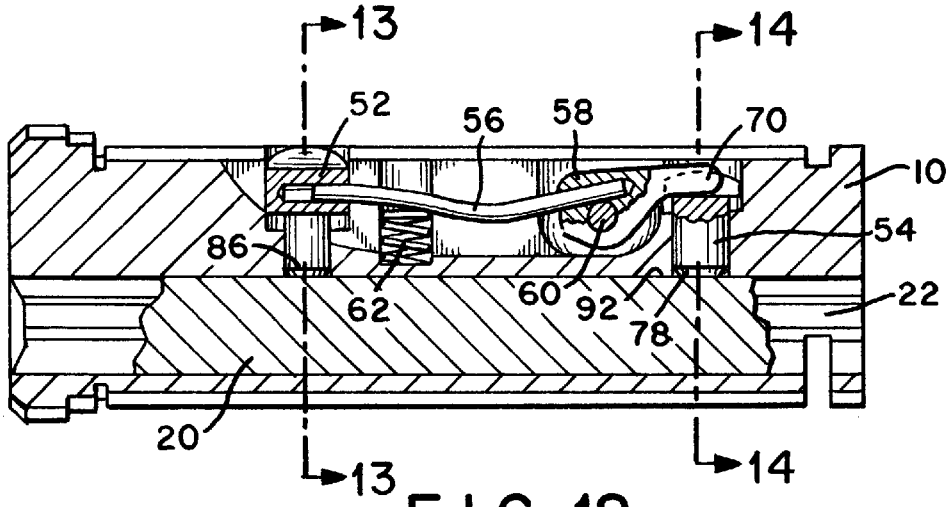
FIG. 12 is a cross sectional view of the plug, removed from the shell, corresponding to the cross sectional view of FIG. 6 except that the lock is shown in the locked position with an incorrect key inserted.
Figure 13:
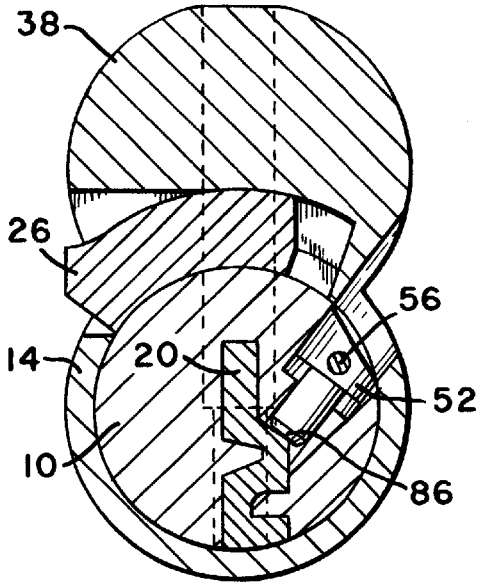
FIG. 13 is a cross sectional view of the cylinder lock taken along the line 13—13 in FIG. 12.
Figure 14:
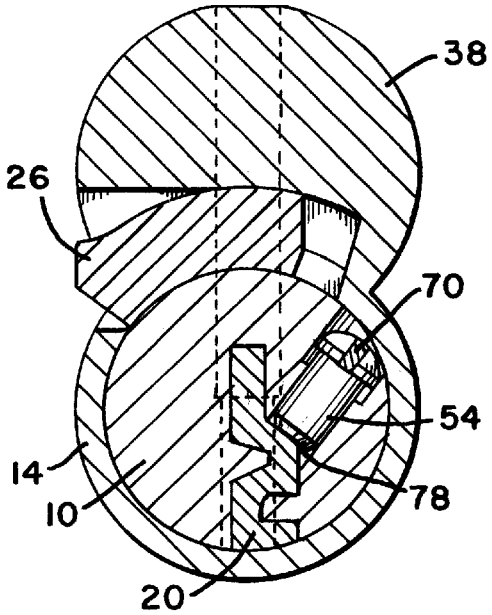
FIG. 14 is a cross sectional view of the cylinder lock taken along the line 14—14 in FIG. 12.

FIGS. 12, 13 and 14 correspond to FIGS. 9, 10 and 11 except that a key without the required locking pin receiving notch 90 is shown inserted into the key slot 22. As can be seen in FIGS. 12 and 14, the incorrect key blade pushes the sensor pin 54 out of the key slot (to the retracted position) in the same way that the correct key moves the sensor pin. However, the incorrect key blade in FIGS. 12, 13 and 14 does not include the locking pin receiving notch and the locking pin cannot move to the unlocked position.

The coupling between the sensor pin and the locking pin formed by rod 56 is sufficiently flexible to permit the sensor pin to move even though the locking pin cannot move. The flexible rod 56 is not damaged or permanently bent and returns to the shape seen in FIG. 6 as soon as the incorrect key is removed. If the incorrect key does not contain the bevel 84 at its tip, it may not be able to move the sensor pin out of the key slot. In this case, the key cannot be fully inserted into the lock.

Even if the key can be fully inserted and contains the correct cuts 44*a*–44*g* on its upper surface, corresponding to the cuts 44*a*–44*g* on the correct key, the additional locking mechanism 50 will not operate and will prevent the plug 10 from being turned relative to the shell 14.

Referring to FIG. 8, the locking pin receiving notch 90 includes a wall surface 120 and a bottom surface 122. The wall surface 120 and bottom surface 122 are preferably formed with a rotating cutter oriented with its axis parallel to the wall surface 120, which is parallel to the axis of the locking pin 52. By cutting the locking pin receiving notch in this way, with the receiving notch oriented at the same angle to the plane of the key blade as the axis of the locking pin, the maximum material is left in the key blade. This prevents the key blade from being unduly weakened.

Further, if the locking pin receiving notch 90 is cut perpendicular to the plane of the key blade, as may occur in an unauthorized attempt to duplicate the key of this invention, the material under key cut 44*d* will be removed. The key is designed so that this will interfere with the deepest permissible cuts at key cut 44*d* and any other key cuts above the locking pin receiving notch. This will prevent operation of the primary pin tumbler locking mechanism by the pins above the locking pin receiving notch if one of the deeper permissible key cuts is used at ally location above that notch. The length of the notch 90 may be adjusted so that it is below more than one key cut, if desired.

As can be seen in FIG. 9, the locking pin 52 and locking pin receiving notch 90 also cooperate to provide a key alignment function for the primary pin tumbler locking mechanism. When key blade 20 is inserted into the key slot 22, it drives the sensor pin 54 to the retracted position and the locking pin 52 to the unlocked position. The locking pin receiving notch 90 includes an alignment surface 94 at one end of the locking pin receiving notch. The alignment surface 94 is part of the vertical wall at the perimeter of the locking pin receiving notch 90 that is formed when the rotating cutter produces wall surface 120 and bottom surface 122.

As the key blade is progressively inserted into the lock, the alignment surface 94 eventually contacts the side of the locking pin 52 at its lower end 86. This contact stops the key blade at exactly the desired position so that the key cuts 44*a*–44*g* are directly under the pins of the primary pin tumbler locking mechanism.

Conventionally, alignment between the key and the pins of the primary pin tumbler locking mechanism is achieved with an alignment surface located at the tip of the key or at the junction between the key bow and the key blade. The conventional alignment surface strikes a stop comprising a fixed part of the cylinder lock mechanism located at the front or rear of the cylinder lock.

By locating the alignment surface at a midpoint along the key in the locking pin receiving notch, instead of at the conventional location, it makes it more difficult to copy the key, which increases security. Another advantage for this location is that it makes the stop point for the key independent of the length of the key. Keys with different lengths can actuate the same lock and keys with the same length can be set to actuate locks of different lengths. This is particularly advantageous for use in cylinder lock families and for keying cylinder locks that are structurally similar, but have different lengths due to a different number of pin tumblers in the primary locking mechanism.

The additional alignment function described above improves security and adds design flexibility, however, it is not necessary that the receiving notch 90 perform this function. The additional locking mechanism 50 can be used with a conventionally aligned key.

Although the locking mechanism 50 is shown as an additional locking mechanism to supplement a conventional pin tumbler locking mechanism, it can also be used independently as a primary locking mechanism. Also, because the locking mechanism 50 sits entirely on one side of the key slot, it may be duplicated on the opposite side of the key slot for additional security. It may also be duplicated multiple times on the same side, and on opposing sides, by changing the angle of the locking mechanism and by overlapping or moving the duplicate locking mechanisms longitudinally as needed to fit the locking mechanisms into the plug.

The present invention also includes three hardened steel pins 96, 98 and 100 located in the front of the plug 10. The steel pins improve security by preventing a drill from penetrating the front of the plug. Three more hardened steel pins 102, 104 and 106 are found in the front of the shell, which serve the same purpose. A faceplate 108 is attached to the front of the lock with a dovetail slot 110 that connects to a matching dovetail 112 on the front of the shell 14. Another hardened steel pin 114 is located in the faceplate 108 and is positioned perpendicular to the six other hardened steel pins.

The plug is held in place with a clip 116 that connects to a ring groove 118 located at the back of the plug 10. To assemble the lock, the locking tab 24 is inserted into opening 12 in the shell. The locking mechanism 50 is installed in the plug and the drill resistant steel pins 96, 98 and 100 are added. The faceplate 108 is then installed and the plug inserted through it and into the opening 12. The clip 116 is then installed in ring groove 118 to hold the plug and faceplate in place. The primary pin tumbler mechanism is installed in the conventional manner.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A cylinder lock comprising:

a shell;

a plug having a key slot formed therein, the plug being rotatably mounted within the shell to define a shear surface between the plug and the shell;

a locking pin movable between a locked position and an unlocked position, the locking pin extending across the shear surface in the locked position to lock the plug against rotation relative to the shell;

a sensor pin movable between an extended position and a retracted position, the sensor pin extending at least partially into the key slot in the extended position; and a flexible coupling connected between the locking pin and the sensor pin, the coupling moving the locking pin to the unlocked position when the sensor pin moves to the retracted position, the coupling being sufficiently flexible to allow the locking pin to remain in the locked position when the sensor pin moves to the retracted position when the locking pin is blocked from moving to the unlocked position.

2. The cylinder lock according to claim 1 wherein the flexible coupling is located inside the plug.

3. The cylinder lock according to claim 1 wherein the locking pin extends at least partially into the key slot when the locking pin is in the unlocked position.

4. The cylinder lock according to claim 1 further including a bias spring connected to urge the locking pin toward the locked position.

5. The cylinder lock according to claim 4 wherein the bias spring is not in axial alignment with the locking pin.

6. The cylinder lock according to claim 1 wherein the flexible coupling includes a flexible rod, the rod flexing when the sensor pin moves to the retracted position and the locking pin is blocked from moving to the unlocked position.

7. The cylinder lock according to claim 6 wherein the locking pin includes an opening in a side of the locking pin and the flexible rod extends into the opening in the side of the locking pin.

8. The cylinder lock according to claim 1 wherein the flexible coupling includes a pivot positioned between the locking pin and the sensor pin, the flexible coupling pivoting on the pivot to move the locking pin to the unlocked position when the sensor pin moves to the retracted position.

9. The cylinder lock according to claim 8 wherein:

the key slot defines a plane for a key blade to be received therein;

the pivot and the flexible coupling are located within the plug; and the locking pin and sensor pin are oriented at an angle between zero and ninety degrees to the plane of the key blade.

10. The cylinder lock according to claim 1 wherein the flexible coupling includes a pivot, a cam mounted on the pivot and a flexible rod connected to the cam, the cam contacting the sensor pin and rotating on the pivot to move the locking pin to the unlocked position with the flexible rod when the sensor pin moves to the retracted position.

11. The cylinder lock according to claim 10 wherein the sensor pin includes a head having a slot formed therein and the cam includes an arm engaging the slot in the head of the sensor pin.

12. The cylinder lock according to claim 10 further including a bias spring connected to urge the locking pin toward the locked position and the sensor pin towards the extended position.

13. The cylinder lock according to claim 12 wherein the bias spring is connected between the plug and the flexible rod to urge the locking pin toward the locked position.

14. The cylinder lock according to claim 1 further including a bias spring connected to urge the flexible rod to move the locking pin toward the locked position and the sensor pin toward the extended position.

15. The cylinder lock according to claim 1 further including a locking tab moveable from locked to unlocked positions, the shell having a predetermined exterior shape for insertion into a casing in a removable core application.

16. A cylinder lock and key comprising:

a shell;

a plug having a key slot formed therein, the plug being rotatably mounted within the shell to define a shear surface between the plug and the shell;

a locking pin movable between a locked position and an unlocked position, the locking pin extending across the shear surface in the locked position and at least partially into the key slot when the locking pin is in the unlocked position;

a sensor pin movable between an extended position and a retracted position, the sensor pin extending at least partially into the key slot in the extended position;

a flexible coupling connected between the locking pin and the sensor pin, the coupling moving the locking pin to the unlocked position when the sensor pin moves to the retracted position, the coupling being sufficiently flexible to allow the locking pin to remain in the locked position when the sensor pin moves to the retracted position if the locking pin is blocked from moving to the unlocked position; and a key having a key blade with a cross sectional shape adapted to match the key slot, the key including a locking pin receiving notch having a size and shape sufficient to permit the locking pin to move to the unlocked position and extend at least partially into the key slot and the locking pin receiving notch when the key is in the key slot, the key also having a contact surface for contacting the sensor pin and moving the sensor pin out of the key slot and into the retracted position when the key is in the key slot.

17. The cylinder lock and key according to claim 16 wherein the flexible coupling is located completely inside the plug.

18. The cylinder lock and key according to claim 16 wherein the flexible coupling includes a pivot, a cam mounted on the pivot and a flexible rod connected to the cam, the cam contacting the sensor pin and rotating on the pivot to move the locking pin to the unlocked position with the flexible rod when the sensor pin moves to the retracted position.

19. The cylinder lock and key according to claim 18 wherein the key blade defines a plane and the pivot is oriented at a non-perpendicular angle to the plane of the key blade.

20. The cylinder lock and key according to claim 19 wherein the contact surface defines a plane, the plane of the contact surface is at an acute angle to the plane of the key blade and the sensor pin moves in a substantially perpendicular direction to the plane of the contact surface.

21. The cylinder lock and key according to claim 16 wherein the key blade includes an upper surface and a lower surface and opposite sides, the contact surface being located on a side of the key blade.

22. The cylinder lock and key according to claim 16 further including a locking tab moveable from locked to unlocked positions, the shell having a predetermined exterior shape for insertion into a casing in a removable core application.

23. The cylinder lock and key according to claim 16 wherein the locking pin receiving notch includes a wall surface oriented parallel to the locking pin when the key is in the key slot.

24. The cylinder lock and key according to claim 23 wherein the wall surface of the locking pin receiving notch is oriented at a non-perpendicular angle to the key blade.

25. The cylinder lock and key according to claim 24 wherein:

the key includes a plurality of key cuts for actuating a pin tumbler locking mechanism; and at least one key cut extends sufficiently into the key such that a line drawn perpendicular to the key blade from the wall surface of the locking pin receiving notch would contact the at least one key cut.

26. A key for operating a cylinder lock, the key comprising:

a key bow for turning the key; and a key blade having a cross sectional shape selected to fit within a key slot in a plug of the cylinder lock, the key blade including a locking pin receiving notch at a first location and a contact surface at a second location on the key blade, the locking pin receiving notch cooperating with a locking pin in the cylinder lock and the contact surface cooperating with a sensor pin in the cylinder lock to lock and unlock the plug of the cylinder lock relative to a shell of the cylinder lock, the cylinder lock comprising:

the plug having the key slot formed therein, the shell, the plug being rotatably mounted within the shell to define a shear surface between the plug and the shell, the locking pin, the locking pin being movable between a locked position and an unlocked position, the locking pin extending across the shear surface in the locked position and at least partially into the locking pin receiving notch in the key blade when the key blade is inserted into the key slot, the sensor pin, the sensor pin being movable between an extended position and a retracted position, the sensor pin contacting the contact surface on the key blade and moving to the retracted position when the key blade is inserted into the key slot, and a flexible coupling connected between the locking pin and the sensor pin, the coupling being sufficiently flexible to allow the locking pin to remain in the locked position when the sensor pin moves to the retracted position if the locking pin is blocked from moving to the unlocked position;

the contact surface of the key blade holding the sensor pin in the retracted position and the flexible coupling of the cylinder lock moving the locking pin to the unlocked position and into the locking pin receiving notch when the key blade is inserted into the key slot in the plug of the cylinder lock.

27. The key according to claim 26 wherein the key blade further includes a bevel at an end thereof, the bevel contacting the sensor pin and moving the sensor pin to the retracted position when the key is inserted into the key slot.

28. The key according to claim 26 wherein the locking pin receiving notch includes a wall surface oriented parallel to the locking pin when the key is in the key slot.

29. The key according to claim 28 wherein the wall surface of the locking pin receiving notch is oriented at a non-perpendicular angle to the key blade.

30. The key according to claim 29 wherein:

the key includes a plurality of key cuts for actuating a pin tumbler locking mechanism; and at least one key cut extends sufficiently into the key such that a line drawn perpendicular to the key blade from the wall surface of the locking pin receiving notch would contact the at least one key cut.

31. A key for operating a cylinder lock, the key comprising:

a key bow for turning the key;

a key blade having a cross sectional shape selected to fit within a key slot in a plug of a cylinder lock;

a locking pin receiving notch formed at a first location in the key blade, the locking pin receiving notch having a size sufficient to receive a locking pin extending into the key slot from the cylinder lock, the locking pin receiving notch including an alignment surface contacting the locking pin when the key blade is inserted into the key slot and cooperating with the locking pin to stop insertion of the key blade into the key slot at a desired position in alignment with the plug of the cylinder lock; and a contact surface at a second location on the key blade, the contact surface cooperating with a sensor pin in the cylinder lock to hold the locking pin in the locking pin receiving notch, the cylinder lock comprising:

the plug having the key slot formed therein, a shell, the plug being rotatably mounted within the shell to define a shear surface between the plug and the shell, the locking pin, the locking pin being movable between a locked position and an unlocked position, the locking pin extending across the shear surface in the locked position and at least partially into the locking pin receiving notch in the key blade when the key blade is inserted into the key slot, the sensor pin, the sensor pin being movable between an extended position and a retracted position, the sensor pin contacting the contact surface on the key blade and moving to the retracted position when the key blade is inserted into the key slot, and a flexible coupling connected between the locking pin and the sensor pin, the coupling being sufficiently flexible to allow the locking pin to remain in the locked position when the sensor pin moves to the retracted position if the locking pin is blocked from moving to the unlocked position.

32. The key according to claim 31 wherein the key blade further includes a bevel at an end thereof, the bevel contacting the sensor pin and moving the sensor pin to the retracted position when the key is inserted into the key slot.

33. The key according to claim 31 wherein the locking pin receiving notch includes a wall surface oriented parallel to the locking pin when the key is in the key slot.

34. The key according to claim 33 wherein the wall Surface of the locking pin receiving notch is oriented at a non-perpendicular angle to the key blade.

35. The cylinder lock and key according to claim 34 wherein:

the key includes a plurality of key cuts for actuating a pin tumbler locking mechanism; and at least one key cut extends sufficiently into the key such that a line drawn perpendicular to the key blade from the wall surface of the locking pin receiving notch would contact the at least one key cut.

* * * * *